US006943140B2

(12) United States Patent
Ashton et al.

(10) Patent No.: US 6,943,140 B2
(45) Date of Patent: Sep. 13, 2005

(54) CARPET CLEANERS

(75) Inventors: Kelleigh Ann Ashton, New York, NY (US); Carol Ann Belansky, New Jersey, NJ (US); Mattia De Dominicis, Padova (IT); Tracy Ann Ryan, New Jersey, NJ (US)

(73) Assignee: Reckitt Benckiser Inc., Wayne, NJ (US)

( * ) Notice: Subject to any disclaimer, the term of this patent is extended or adjusted under 35 U.S.C. 154(b) by 348 days.

(21) Appl. No.: 10/332,828

(22) PCT Filed: Jul. 11, 2001

(86) PCT No.: PCT/GB01/03106

§ 371 (c)(1),
(2), (4) Date: Jan. 13, 2003

(87) PCT Pub. No.: WO02/06435

PCT Pub. Date: Jan. 24, 2002

(65) Prior Publication Data

US 2003/0162678 A1 Aug. 28, 2003

(30) Foreign Application Priority Data

Jul. 14, 2000 (GB) ..... 0017291

(51) Int. Cl.[7] ..... C11D 17/04; D06L 17/04

(52) U.S. Cl. ..... 510/278; 510/280

(58) Field of Search ..... 510/278, 280

(56) References Cited

U.S. PATENT DOCUMENTS

| | | | | |
|---|---|---|---|---|
| 4,652,389 | A | 3/1987 | Moll | 252/90 |
| 5,391,316 | A | 2/1995 | Garrett et al. | 252/126 |
| 5,925,608 | A | 7/1999 | Spruyt et al. | 510/276 |

FOREIGN PATENT DOCUMENTS

| | | |
|---|---|---|
| WO | 89 12673 | 12/1989 |
| WO | 98 04666 | 2/1998 |

*Primary Examiner*—Yogendra N. Gupta
*Assistant Examiner*—John M Petruncio
(74) *Attorney, Agent, or Firm*—Norris McLaughlin & Marcus PA

(57) ABSTRACT

An improved quick breaking foam carpet cleaner is provided. Good cleaning is achieved and the foam breaks quickly, allowing for quicker cleaning and use of the carpet without the need for subsequent vacuuming.

13 Claims, No Drawings

CARPET CLEANERS

FIELD OF THE INVENTION

This invention relates to fabric cleaning compositions of the type adaptable for use in the cleaning of textile fabrics such as carpets, and more particularly to cleaning compositions for carpets that do not require rubbing, scrubbing, or vacuuming.

BACKGROUND OF THE INVENTION

Fabric cleaning formulations have been previously developed and employed in the cleaning of textile fabrics of the type normally found in carpets and rugs. Many of the prior fabric cleaning formulations involve the use of detergent materials in aqueous or solvent mediums, in which dirt and soil are removed by normal detergent action. Others involve formulations which are applied dry or damp to the fabric surface. Soil and dirt particles are, in effect, loosened by mild detergent action. Loosened particles are then adsorbed on particles of filler material and thereafter vacuumed from the fabric.

A disadvantage to many of the previous cleaning formulations is that the cleaned area is wet or damp for a long period of time, making the carpeted area unusable. In addition, some carpet cleaners are of the foam type in which the foam will remain stable for a long period of time, for example 15 to 20 minutes, before it collapses. Thereafter, the carpet is allowed to dry, when dry it can be vacuumed and then used.

Thus, an object of the present invention is to provide a composition with a quick breaking foam or even a bubbling action that cleans a variety of stains without the need for subsequent vacuuming of the carpet. In so doing, the carpeted area that has been cleaned will be useable in a shorter period of time.

SUMMARY OF THE INVENTION

The present invention is directed to a foaming or bubbling composition for cleaning carpets which comprises a solvent system comprising one or more organic solvents; a surfactant selected from the group consisting of anionic surfactant, non-ionic surfactant, and mixtures thereof; a propellant; and water. The composition may also contain an hydrotrope. The composition optionally contains one or more cationic surfactants, one or more corrosion inhibitors, pH buffering agents, perfumes, perfume carriers, pH adjusting agents, pH buffers, antioxidants, antimicrobials, germicidals, fungicidals, acaricides, allergen neutralizer and preservatives, wherein the foam breaks within ten minutes of application to the carpet.

The organic solvents can be selected from one or more of glycol ethers, m-Pyrol, low molecular weight alcohols, and mixtures thereof. Examples of glycol ethers include ethylene glycol monomethyl ether, ethylene glycol monobutyl ether, diethylene glycol monomethyl ether, diethylene glycol monobutyl ether, propylene glycol phenyl ether, propylene glycol monomethyl ether, dipropylene glycol methyl ether, propylene glycol monopropyl ether, dipropylene glycol monopropyl ether, propylene glycol monobutyl ether, dipropylene glycol monobutyl ether and ethylene glycol monohexyl ether. Examples of low molecular weight alcohols include methanol, ethanol, n-propanol, isopropanol, and the like. Preferably, the solvent system is selected from the group consisting of propylene glycol monopropyl ether or a mixture of dipropylene glycol methyl ether and dipropylene glycol monobutyl ether.

The non-ionic surfactant is preferably a surfactant having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Examples of other non-ionic surfactants include higher aliphatic primary alcohols containing about twelve to about 16 carbon atoms which are condensed with about three to thirteen moles of ethylene oxide.

Other examples of nonionic surfactants include primary alcohol ethoxylates (available under the Neodol tradename from Shell Co.), such as $C_{11}$ alkanol condensed with 9 moles of ethylene oxide (Neodol 1-9), $C_{12-13}$ alkanol condensed with 6.5 moles ethylene oxide (Neodol 23-6.5), $C_{12-13}$ alkanol with 9 moles of ethylene oxide (Neodol 23-9), $C_{12-15}$ alkanol condensed with 7 or 3 moles ethylene oxide (Neodol 25-7 or Neodol 25-3), $C_{14-15}$ alkanol condensed with 13 moles ethylene oxide (Neodol 45-13), $C_{9-11}$ linear ethoxylated alcohol, averaging 2.5 moles of ethylene oxide per mole of alcohol (Neodol 91-2.5), and the like.

Other examples of non-ionic surfactants suitable for use in the present invention include ethylene oxide condensate products of secondary aliphatic alcohols containing 11 to 18 carbon atoms in a straight or branched chain configuration condensed with 5 to 30 moles of ethylene oxide. Examples of commercially available nonionic detergents of the foregoing type are $C_{11-15}$ secondary alkanol condensed with either 9 moles of ethylene oxide (Tergitol 15-S-9) or 12 moles of ethylene oxide (Tergitol 15-S-12) marketed by Union Carbide, a subsidiary of Dow Chemical.

Octylphenoxy polyethoxyethanol type non-ionic surfactants, for example, Triton X-100, as well as amine oxides can also be used as a non-ionic surfactant in the present invention.

Other examples of linear primary alcohol ethoxylates are available under the Tomadol tradename such as, for example, Tomadol 1-7, a $C_{11}$ linear primary alcohol ethoxylate with 7 moles EO; Tomadol 25-7, a $C_{12}$–$C_{15}$ linear primary alcohol ethoxylate with 7 moles EO; Tomadol 45-7,a $C_{14}$–$C_{15}$ linear primary alcohol ethoxylate with 7 moles EO; and Tomadol 91-6, a $C_9$–$C_{11}$, linear alcohol ethoxylate with 6 moles EO.

Anionic surfactants can also be used in the present invention. Suitable anionic surfactants include, for example, alcohol sulfates (e.g. alkali metal or ammonium salts of alcohol sulfates) and sulfonates, alcohol phosphates and phosphonates, alkyl sulfonates, ethoxylated alkyl sulfonates, alkylaryl sulfonates, $C_{10-16}$ alkyl benzene sulfonates, $C_{10-18}$ alkyl alkoxy carboxylates having 1 to 5 moles of ethylene oxide, and the $C_{10-18}$ sarcosinates.

The compositions of the present invention also contain propellants such as pressurized gases, including carbon dioxide, air, nitrogen, nitrous oxide, as well as others, for example, propane, butane, pentane, isobutane, isopentane, mixtures of hydrocarbon gases (such as, for example, A-46 and A-70 available from Phillips Petroleum, CAP 40 and CAP 48 available from Shell, BPAP 40 available from BP Chemicals), dimethyl ether, and mixtures thereof. The amount of propellant used is generally between 2 and 20% w/w of the entire composition. More preferably between 3 and 10% w/w of the entire composition. Typically, 6% w/w propellant is used.

The foam composition of the present invention is designed so that it collapses, or breaks, within a short period of time, preferably less than ten minutes, more preferably less than five minutes, even more preferably less than one minute and most preferably less than thirty seconds. Alternatively the composition can give a bubbling action for a short period of time, preferably less than five minutes, more preferably less than one minute even more preferably less than thirty seconds. The quick breaking of the foam or the bubbling action permits the spot to blotted up quickly, allowing the carpeted surface to be used in a shorter period of time over conventional foam-type carpet cleaners where the time for the foam to collapse is longer, making clean-up time longer.

The present invention also relates to a process for the removal of stains from carpets which comprises the step of applying an effective amount of the composition of the present invention to a carpet in need of such treatment.

DETAILED DESCRIPTION OF THE INVENTION

The present invention is directed to a foam composition for cleaning carpets which comprises a solvent system comprising one or more organic solvents; a surfactant selected from the group consisting of anionic surfactant, non-ionic surfactant, and mixtures thereof; a propellant; and water. The composition may also contain an hydrotrope. The composition optionally contains one or more cationic surfactants, one or more corrosion inhibitors, pH buffering-agents, perfumes, perfume carriers, pH adjusting agents, pH buffers, antioxidants, antimicrobials, germicidals, fungicidals, acaricides, allergen neutralizer and preservatives, wherein the foam breaks within ten minutes of application to the carpet.

The organic solvents can be selected from one or more of glycol ethers, m-Pyrol, low molecular weight alcohols, and mixtures thereof. Examples of glycol ethers include ethylene glycol monomethyl ether, ethylene glycol monobutyl ether, diethylene glycol monomethyl ether, diethylene glycol monobutyl ether, propylene glycol phenyl ether, propylene glycol monomethyl ether, dipropylene glycol methyl ether, propylene glycol monopropyl ether, dipropylene glycol monopropyl ether, propylene glycol monobutyl ether, dipropylene glycol monobutyl ether and ethylene glycol monohexyl ether. Examples of low molecular weight alcohols include methanol, ethanol, n-propanol, isopropanol, and the like. Preferably, the solvent system is selected from the group consisting of propylene glycol monopropyl ether or a mixture of dipropylene glycol methyl ether and dipropylene glycol monobutyl ether.

The non-ionic surfactant is preferably a surfactant having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol®, available from Hoechst Celanese Corp., Charlotte, N.C., including the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N, both of which are commercially available from Hoechst Celanese Corp. From product literature, the single number following the "L" corresponds to the average degree of ethoxylation (numbers between 1 and 5) and the two digit number following the letter "L" corresponds to the cloud point in ° C. of a 1.0 wt. % solution in water.

Examples of other non-ionic surfactants include higher aliphatic primary alcohols containing about twelve to about 16 carbon atoms which are condensed with about three to thirteen moles of ethylene oxide.

Amine oxides can also be used as the non-ionic surfactant of the present invention. Exemplary useful amine oxide compounds may be defined as one or more of the following of the four general classes:

(1) Alkyl di (lower alkyl) amine oxides in which the alkyl group has about 6–24, and preferably 8–18 carbon atoms, and can be straight or branched chain, saturated or unsaturated. The lower alkyl groups include between 1 and 7 carbon atoms, but preferably each include 1–3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(2) Alkyl di (hydroxy lower alkyl) amine oxides in which the alkyl group has about 6–22, and preferably 8–18 carbon atoms, and can be straight or branched chain, saturated or unsaturated. Examples include bis-(2-hydroxyethyl) cocoamine oxide, bis(2-hydroxyethyl) tallowamine oxide; and bis-(2-hydroxyethyl) stearylamine oxide;

(3) Alkylamidopropyl di(lower alkyl) amine oxides in which the alkyl group has about 10–20, and preferably 12–16 carbon atoms, and can be straight or branched chain, saturated or unsaturated. Examples include cocoamidopropyl dimethyl amine oxide and tallowamidopropyl dimethyl amine oxide; and (4) Alkylmorpholine oxides in which the alkyl group has about 10–20, and preferably 12–16 carbon atoms, and can be straight or branched chain, saturated or unsaturated.

Other examples of nonionic surfactants include primary alcohol are ethoxylates (available under the Neodol tradename from Shell Co.), such as $C_{11}$ alkanol condensed with 9 moles of ethylene oxide (Neodol 1-9), $C_{12-13}$ alkanol condensed with 6.5 moles ethylene oxide (Neodol 23-6.5), $C_{12-13}$ alkanol with 9 moles of ethylene oxide (Neodol 23-9), $C_{12-15}$ alkanol condensed with 7 or 3 moles ethylene oxide (Neodol 25-7 or Neodol 25-3), $C_{14-15}$ alkanol condensed with 13 moles ethylene oxide (Neodol 45-13), and the like.

Other examples of non-ionic surfactants suitable for use in the present invention include ethylene oxide condensate products of secondary aliphatic alcohols containing 11 to 18 carbon atoms in a straight or branched chain configuration condensed with 5 to 30 moles of ethylene oxide. Examples of commercially available nonionic detergents of the foregoing type are $C_{11-15}$ secondary alkanol condensed with either 9 moles of ethylene oxide (Tergitol 15-S-9) or 12 moles of ethylene oxide (Tergitol 15-S-12) marketed by Union Carbide, a subsidiary of Dow Chemical.

Octylphenoxy polyethoxyethanol type non-ionic surfactants, for example, Triton X-100, from Rohm & Haas, are also useful in the present invention.

Anionic surfactants can also be used in the present invention. Suitable anionic surfactants include, for example, alcohol sulfates (e.g. alkali metal or ammonium salts of alcohol sulfates) and sulfonates, alcohol phosphates and phosphonates, alkyl sulfonates, ethoxylated alkyl sulfonates, alkylaryl sulfonates, $C_{10-16}$ alkyl benzene sulfonates, $C_{10-18}$ alkyl alkoxy carboxylates having 1 to 5 moles of ethylene oxide, and the $C_{10-18}$ sarcosinates Preferably, the alkyl chain length of a chosen surfactant will range from about nine-eleven carbon atoms to about 16 carbon atoms.

In the present invention, the preferred non-ionic surfactants are found in the Examples. The amount of non-ionic surfactant present in the compositions ranges from about 0.2 to about 0.5 wt. %, preferably from about 0.2 to about 0.4 wt % of the composition.

The compositions of the present invention also contain propellants such as pressurized gases, including carbon dioxide, air, nitrogen, nitrous oxide, as well as others, for example, propane, butane, pentane, isobutane, isopentane, mixtures of hydrocarbon gases (such as, for example, A-46 and A-70 available from Phillips-Petroleum, CAP 40 and CAP 48 available from Shell, BPAP 40 available from BP Chemicals), dimethyl ether, and mixtures thereof. The amount of propellant used is generally between 2 and 20% w/w of the entire composition. More preferably between 3 and 10% w/w of the entire composition. Typically, 6% w/w propellant is used.

The present invention also relates to a process for the removal of stains from carpets which comprises the step of applying an effective amount of the composition of the present invention to a carpet in need of such treatment.

The compositions are largely aqueous in nature, and comprise water. Water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially mineral salts which are present in hard water which may thus undesirably interfere with the operation of the constituents present in the aqueous compositions according to the invention.

The composition of the present invention may also contain one or more hydrotropes. Suitable hydrotropes are sodium cumene sulfonate (ELTESOL SC40 available from Albright & Wilson), sodium xylene sulfonate (ELTESOL SX40 available from Albright & Wilson), di-sodium mono- and di-alkyl disulfonate diphenyloxide (DOWFAX 3B2 available from Dow Chemicals), n-octane sodium sulfonate (BIOTERGE PAS 7 S or 8 S available from Stepan).

The compositions of the present invention can optionally contain one or more cationic surfactants, one or more corrosion inhibitors, pH buffering agents, perfumes, perfume carriers, pH adjusting agents, pH buffers, antioxidants, antimicrobials, germicidals, fungicidals, acaricides, allergen neutralizer and preservatives which, when present, should be present in minor amounts, preferably in total comprise less than about 5% by weight (on an active weight basis) of the compositions, and desirably less than about 3%wt. It is known that certain types of fragrances can have an effect on the speed in which the foam breaks, but even with fragrance in the composition, the foam will still break within the range of ten minutes.

The foam composition of the present invention is designed so that it collapses, or breaks, within a short period of time, preferably less than ten minutes, more preferably less than five minutes, even more preferably less than one minute and most preferably less than thirty seconds. Alternatively the composition can give a bubbling action for a short period of time, preferably less than five minutes, more preferably less than one minute even more preferably less than thirty seconds. The quick breaking of the foam or the bubbling action permits the spot to blotted up quickly, allowing the carpeted surface to be used in a shorter period of time over conventional foam-type carpet cleaners where the time for the foam to collapse is longer, making clean-up time longer.

The foaming/bubbling composition is applied to the stained area on the carpet. The instantaneous foam/bubble production causes the stain to be lifted to the surface of the carpet pile and then the foam collapses. The stain is brought to the surface of the carpet, making it easier to blot and remove. While not being limited to this theory, it is believed that part of the good cleaning seen with the compositions of the present invention is due forces generated by the quick collapse of the foam, which causes the stains to lifted to the surface of the carpet.

The present invention also relates to a process for the removal of stains from carpets which comprises the step of applying an effective amount of the composition of the present invention to a carpet in need of such treatment.

The composition is typically prepared by mixing all the components together in a suitable container to form a concentrate, placing an amount of the concentrate in a suitable container useful to dispense aerosols, and then the propellant is added. For the examples below, a charge of the example formulation (equal to 94% of the finished product) is placed in a suitable canister and charged with 6% propellant. Examples of compositions forming a part of the present invention are set forth below in Table 1 with the various components identified in Table 2.

TABLE 1

| Components | Ex. 1 % | Ex. 2 % | Ex. 3 % | Ex. 4 % | Ex. 5 % | Ex. 6 % | Ex. 7 % |
|---|---|---|---|---|---|---|---|
| DI Water | 82.45 | 82.45 | 82.25 | 81.45 | 81.45 | 81.45 | 81.45 |
| Dowanol DPnB | 4.5 | — | 4.5 | 4.5 | 4.5 | 4.5 | 4.5 |
| Dowanol DPM | 12.5 | — | 12.5 | 12.5 | 12.5 | 12.5 | 12.5 |
| Dowanol PnP | — | 17 | — | — | — | — | — |
| Dowanol EB | — | — | — | — | — | — | — |
| IPA | — | — | — | — | — | — | — |
| Genapol 26-L-60 | — | 0.2 | — | — | 0.2 | — | 0.2 |
| Genapol 26-L-80 | 0.2 | — | 0.2 | 0.2 | — | 0.2 | — |
| Syntran 1575 | — | — | — | 1 | 1 | — | — |
| Syntran 1580 | — | — | — | — | — | 1 | 1 |
| Triton X-100 | — | — | — | — | — | — | — |
| Sodium Benzoate | 0.3 | 0.3 | — | 0.3 | 0.3 | 0.3 | 0.3 |

TABLE 1-continued

| | | | | | | | |
|---|---|---|---|---|---|---|---|
| Monacor BE | — | — | 0.5 | — | — | — | — |
| Sodium Nitrite | — | — | — | — | — | — | — |
| Ammonium Hydroxide | 0.05 | 0.05 | 0.05 | 0.05 | 0.05 | 0.05 | 0.05 |
| Total | 100 | 100 | 100 | 100 | 100 | 100 | 100 |

| Components | Ex. 8 % | Ex. 9 % | Ex. 10 % | Ex. 11 % | Ex. 12 % | Ex. 13 % | Ex. 14 % |
|---|---|---|---|---|---|---|---|
| DI Water | 79.75 | 79.35 | 82.55 | 81.65 | 81.65 | 82.55 | 78.55 |
| Dowanol DPnB | — | — | 4.5 | 4.5 | — | — | 4.5 |
| Dowanol DPM | — | — | 12.5 | 12.5 | — | — | 16.5 |
| Dowanol PnP | — | — | — | — | 17 | 17 | — |
| Dowanol EB | 15 | 15 | — | — | — | — | — |
| IPA | 5 | 5 | — | — | — | — | — |
| Genapol 26-L-60 | — | — | — | — | 0.2 | 0.2 | — |
| Genapol 26-L-80 | — | — | 0.2 | 0.2 | — | — | 0.2 |
| Triton X-100 | 0.05 | 0.05 | — | — | — | — | — |
| Sodium Benzoate | — | — | — | 0.3 | 0.3 | — | — |
| Monacor BE | — | 0.5 | — | 0.8 | 0.8 | — | — |
| Sodium Nitrite | 0.1 | — | 0.2 | — | — | 0.2 | 0.2 |
| Ammonium Hydroxide | 0.1 | 0.1 | 0.05 | 0.05 | 0.05 | 0.05 | 0.05 |
| Total | 100 | 100 | 100 | 100 | 100 | 100 | 100 |

| Components | Ex. 15 % | Ex. 16 % | Ex. 17 % | Ex. 18 % | Ex. 19 % | Ex. 20 % | Ex. 21 % |
|---|---|---|---|---|---|---|---|
| DI Water | 77.65 | 77.65 | 81.65 | 82.2 | 82.2 | 82.2 | 82.2 |
| Dowanol DPnB | 4.5 | 3.5 | — | — | — | 17 | — |
| Dowanol DPM | 16.5 | 17.5 | 8.5 | — | — | — | — |
| Dowanol PnP | — | — | 8.5 | — | — | — | — |
| Dowanol EB | — | — | — | 17 | 17 | — | — |
| Dowanol PM | — | — | — | — | — | — | 17 |
| Genapol 26-L-60 | — | — | 0.2 | 0.2 | 0.2 | 0.2 | 0.2 |
| Genapol 26-L-80 | 0.2 | 0.2 | — | — | — | — | — |
| Sodium Benzoate | 0.3 | 0.3 | 0.3 | 0.3 | 0.3 | 0.3 | 0.3 |
| Monacor BE | 0.8 | 0.8 | 0.8 | — | — | — | — |
| Sodium Bicarbonate | — | — | — | 0.1 | 0.1 | 0.34 | 0.1 |
| Fragrance | — | — | — | 0.2 | 0.2 | 0.2 | 0.2 |
| Ammonium Hydroxide | 0.05 | 0.05 | 0.05 | — | drop-wise | drop-wise | drop-wise |
| Total | 100 | 100 | 100 | 100 | 100 | 100.24 | 100 |

| Components | Ex. 22 % | Ex. 23 % | Ex. 24 % | Ex. 25 % | Ex. 26 % | Ex. 27 % | Ex. 28 % |
|---|---|---|---|---|---|---|---|
| DI Water | 82.2 | 82.2 | 82.45 | 82.45 | 82.45 | 82.45 | 82.45 |
| Dowanol DPnB | — | — | — | — | — | 4.5 | 4.5 |
| Dowanol EB | — | 17 | — | — | 8.5 | — | — |
| Dowanol PM | — | — | — | — | — | — | — |
| Dowanol DB | 17 | — | — | — | — | — | — |
| Dowanol DPM | — | — | — | — | — | 12.5 | 12.5 |
| m-Pyrol | — | — | 17 | 15.5 | 8.5 | — | — |
| Hexyl Cellosolve | — | — | — | 1.5 | — | — | — |
| Genapol 26-L-3 | — | 0.2 | — | — | — | — | — |
| Genapol 26-L-60 | 0.2 | — | 0.2 | 0.2 | 0.2 | — | — |
| Neodol 91-2.5 | — | — | — | — | — | 0.2 | — |
| Tergitol 15-S-9 | — | — | — | — | — | — | 0.2 |
| Sodium Benzoate | 0.3 | 0.3 | 0.3 | 0.3 | 0.3 | 0.3 | 0.3 |
| Sodium Bicarbonate | 0.17 | 0.17 | — | — | — | — | — |
| Fragrance | 0.2 | 0.2 | — | — | — | — | — |
| Ammonium Hydroxide | drop-wise | drop-wise | 0.05 | 0.05 | 0.05 | 0.05 | 0.05 |
| Total | 100.07 | 100.07 | 100 | 100 | 100 | 100 | 100 |

| Components | Ex. 29 % | Ex. 30 % | Ex. 31 % | Ex. 32 % | Ex. 33 % | Ex. 34 % | Ex. 35 % |
|---|---|---|---|---|---|---|---|
| DI Water | 77.45 | 80.15 | 77.15 | 77.25 | 78.73 | 79.98 | 81.1 |
| Dowanol DPnB | 4.5 | 4.5 | 4.5 | 4.5 | 4.5 | 4.5 | 4.5 |
| Dowanol DPM | 12.5 | 12.5 | 12.5 | 12.5 | 12.5 | 12.5 | 12.5 |
| Dowanol PnP | | | | | | | |
| Eltesol SC 40 | 5 | 2.2 | 5 | 5 | 2.5 | 1.25 | |
| Dowfax 3B2 | | | | | | | 1.13 |
| Genapol 26-L-60 | | | | | | | |
| Genapol 26-L-80 | 0.2 | 0.2 | 0.2 | 0.2 | 0.2 | 0.2 | 0.2 |

TABLE 1-continued

| | | | | | | | |
|---|---|---|---|---|---|---|---|
| Sodium Benzoate | 0.3 | 0.3 | 0.6 | | 0.6 | 0.6 | 0.3 |
| Monacor BE | | | | 0.5 | 0.82 | 0.82 | |
| Sodium Bicarbonate | | | | | | | 0.17 |
| Fragrance | | 0.1 | | | | | 0.1 |
| Ammonium Hydroxide | 0.05 | 0.05 | 0.05 | 0.05 | 0.15 | 0.15 | |
| Total | 100 | 100 | 100 | 100 | 100 | 100.24 | 100 |

TABLE 2

| Component | Description of Component |
|---|---|
| DI Water | Deionized water |
| Dowanol DPnB | Dipropylene glycol n-butyl ether from Dow Chemical |
| Dowanol DPM | Dipropylene glycol methyl ether from Dow Chemical |
| Dowanol PnP | Propylene glycol n-propyl ether from Dow Chemical |
| Dowanol EB | Ethylene glycol n-butyl ether from Dow Chemical |
| Dowanol PM | Propylene glycol methyl ether from Dow Chemical |
| Dowanol DB | Diethylene glycol n-butyl ether from Dow Chemical |
| m-Pyrol | N-methyl-pyrrolidone from ISP |
| Hexyl Cellosolve | Ethylene glycol monohexyl ether from Dow Chemical |
| IPA | Isopropyl alcohol |
| Genapol 26-L-60 | Primary alcohol ethoxylate from Hoechst Celanese |
| Genapol 26-L-80 | Primary alcohol ethoxylate from Hoechst Celanese |
| Syntran 1575 | Acrylic copolymer from Interpolymer Corporation |
| Syntran 1580 | Carboxylated acrylic copolymer from Interpolymer Corporation |
| Neodol 91-2.5 | $C_{9-11}$ linear ethoxylated alcohol, averaging 2.5 moles of ethylene oxide per mole of alcohol from Shell Chemical |
| Tergitol 15-S-9 | $C_{11-15}$ secondary alkanol condensed with 9 moles of ethylene oxide from Union Carbide, a subsidiary of Dow Chemical |
| Monacor BE | Monoethanolamine borate/monoisopropanolamine borate mixture (100%) from Uniqema |
| Sodium Nitrite | Sodium nitrite |
| Sodium Bicarbonate | Sodium bicarbonate |
| Fragrance | Proprietary fragrance from various suppliers |
| Sodium Benzoate | Sodium benzoate |
| Eltesol SC 40 | Sodium cumene sulphonate |
| Ammonium Hydroxide | Ammonium hydroxide |

Certain compositions of Table 1 were evaluated in a cleaning test and were compared against a commercially available product "Spot Shot" which is advertised as an instant carpet cleaner ("Commercial Product"). The Commercial Product is believed to contain about 5% propellant, about 16 to 17% solvent (butyl cellosolve), about 0.8% Monacor BE, about 0.26% sodium benzoate, about 0.15% nonyl phenol type non-ionic surfactant, the balance being water.

The cleaning test that was conducted consisted of five stains cleaned with three compositions and five repetitions of each stain for each composition. The five stains tested were: Red Ink; Dirty Motor Oil; Red Wine; Spaghetti Sauce; and Coffee.

The compositions tested were Ex. 1; Ex. 2; and Commercial Product.

The test was conducted as follows: 6"×6" swatches of carpet were stained with the appropriate amount of the appropriate product.

| |
|---|
| Red Ink - 2" × 2" X |
| Dirty Motor Oil - 0.5 g |
| Red Wine - 1.5 g |
| Spaghetti Sauce - 2.0 g |
| Coffee - 1.5 g |

The stains were allowed to dry for 24 hrs. in the room temperature chamber. Thereafter, approximately 9.5 g of the appropriate composition were applied on each swatch. Then, each swatch was blotted by hand twice for a count of ten. The swatches were allowed to dry overnight in the room temp chamber. The swatches were visually scored based on a scale from 0–100. 0=no soil removal and 100=complete soil removal.

The results were as follows:

For Red Ink: Ex. 1 is statistically better than Ex. 2. Both examples were at parity with the Commercial Product.

For Dirty Motor Oil: Ex. 1 and Ex. 2 were both at parity with the Commercial Product.

For Red Wine: Ex. 1 was at parity with Ex. 2. Both examples were prototypes were statistically better over the Commercial Product.

For Spaghetti Sauce: Ex. 1 and Ex. 2 were both at parity with the Commercial Product.

For Coffee: Ex. 1 was at parity with Ex. 2 and the Commercial Product. The Commercial Product was statistically better than Ex. 2.

We claim:

1. A foaming or bubbling carpet cleaning composition comprising:

a) a glycol ether organic solvent; wherein the solvent is selected from either a mixture of dipropylene glycol methyl ether and dipropylene glycol n-butyl ether or propylene glycol n-propyl ether b) a non-ionic surfactent;

c) a propellant; and d) water, the composition may contain at least one hydrotope, the composition optionally contains at least one cationic surfactant, at least one corrosion inhibitor, pH buffeting agents, perfumes, perfume carriers, pH adjusting agents, pH buffers, antioxidants, antimicroblals, germicidals, fungicidals, acaricides, allergen neutralizer and preservatives, wherein the foam breaks within ten minutes of application to the carpet.

2. The composition of claim 1 wherein the solvent (a) is propylene glycol n-propyl ether.

3. The composition of claim 1 wherein the non-ionic surfactant is a primary alcohol ethoxylate or a secondary alcohol ethoxylate.

4. The composition of claim 3 wherein the non-ionic surfactant is a secondary alcohol ethoxylate.

5. The composition of claim 4 wherein the non-ionic surfactant is a primary alcohol ethoxylate of formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12.

6. The composition of claim 1 wherein the foam breaks within or the bubbling action lasts for less than five minutes of application to the carpet.

7. The composition of claim 6 wherein the foam breaks within or the bubbling action lasts for at least one minute of application to the carpet.

8. The composition of claim 7 wherein the foam breaks within or the bubbling action lasts for at least thirty seconds of application to the carpet.

9. The composition of claim 8 wherein the foam breaks within or the bubbling action lasts for at least fifteen seconds of application to the carpet.

10. The composition of claim 1 wherein the solvent (a) is a mixture of dipropylene glycol methyl ether and dipropylene glycol n-butyl ether.

11. The composition of claim 1 wherein the hydrotope is selected from the group consisting of sodium cumene sulfonate, sodium xylene sulfonate, di-sodium mono- and di-alkyl disulfonate diphenyloxide, and n-octane sodium sulfonate.

12. The composition of claim 11 wherein the hydrotope is sodium cumene sulfonate.

13. A process for the removal of stains from carpeting which comprises the step of applying an effective amount of the composition according to claim 1 to a carpet needing such treatment.

* * * * *